US005709267A

United States Patent [19]

Long et al.

[11] Patent Number: 5,709,267

[45] Date of Patent: Jan. 20, 1998

[54] AQUEOUS PARTICULATE DISPERSION FOR REDUCING THE WATER INFLUX RATE INTO A WELLBORE

[75] Inventors: Edward A. Long, Highlands Ranch, Colo.; George E. King, Sand Springs, Okla.

[73] Assignee: Amoco Corporation, Chicago, Ill.

[21] Appl. No.: 551,899

[22] Filed: Oct. 23, 1995

[51] Int. Cl.[6] ..... E21B 33/138; E21B 43/267

[52] U.S. Cl. ..... 166/280; 166/281; 166/292

[58] Field of Search ..... 166/280, 281, 166/290, 292, 283

[56] References Cited

U.S. PATENT DOCUMENTS

| | | | |
|---|---|---|---|
| 3,126,056 | 3/1964 | Harrell | 166/281 X |
| 3,241,613 | 3/1966 | Kern et al. | 166/281 X |
| 3,242,986 | 3/1966 | Hower . | |
| 3,249,158 | 5/1966 | Kieschnick, Jr. et al. | 166/281 X |
| 3,583,165 | 6/1971 | West et al. . | |
| 3,616,856 | 11/1971 | Knight et al. | 166/288 |
| 4,109,721 | 8/1978 | Slusser | 166/280 |
| 4,397,353 | 8/1983 | Lacy | 166/281 |
| 4,478,282 | 10/1984 | Nolte et al. | 166/281 |
| 5,181,568 | 1/1993 | McKown et al. | 166/293 |
| 5,348,584 | 9/1994 | Brothers et al. | 106/725 |

FOREIGN PATENT DOCUMENTS

| | | |
|---|---|---|
| 1233408 | 3/1988 | Canada . |
| 521376A2 | 7/1993 | European Pat. Off. . |
| WO9212325 | 7/1992 | WIPO . |

OTHER PUBLICATIONS

K. L. Harris and B. J. Johnson, "Successful Remedial Operations using Ultrafine Cement", pp. 21–30, a paper presented at the SPE Mid–Continent Gas Symposium held in Amarillo, Texas, SPE 24294 (Apr. 13–14, 1992).

W. J. Clarke and A. C. McNally, "Ultrafine Cement for Oilwell Cementing", pp. 291–298, a paper presented at the SPE Rocky Mountain Regional/Low Permeability Reservoirs Symposium held in Denver, CO, SPE 25868 (Apr. 12–14, 1993).

J. F. Heathman and L. E. East Jr., "Case Histories Regarding the Application of Microfine Cements", pp. 723–732, a paper presented at the 1992 IADC/SPE Drilling Confernece held in New Orleans, LA, SPE 23926 (Feb. 18–21, 1992).

E. D. Dalrymple, J. A. Dahl, L. E. East, and K. W. McKown, "A Selective Water Control Process", pp. 225–230, a paper presented at the SPE Rocky Mountain Regional Meeting held in Casper, Wyoming, SPE 24330 (May 18–21, 1992).

J. A. Dahl, P. D. Nguyen, E. D. Dalrymple, and A. B. Rahimi, "Current Water–Control Treatment Designs", pp. 129–142, a paper presented at the European Petroleum Conference held in Cannes, France, SPE 25029 (Nov. 16–18, 1992).

C. F. Garcia and R. L. Otto, "Evaluation of a New Sealing Fluid for Water Control Problems as Well as for Sealing Highly Porous Formations", pp. 1–6, a paper prepared for the Rocky Mountain Regional Meeting of the Society of Petroleum Engineers of AIME, held in Denver, CO, SPE 3884 (Apr. 10–12, 1972).

(List continued on next page.)

*Primary Examiner*—George A. Suchfield
*Attorney, Agent, or Firm*—Robert E. Sloat

[57] ABSTRACT

A method for reducing the water influx into a wellbore which penetrates a natural gas hydrocarbon-containing formation having a communication channel that extends from the wellbore into the formation and that is filled with proppant particles. In one embodiment, an aqueous particulate dispersion is introduced into the formation until a volume of the dispersion particles introduced is equal to or greater than one-half a water zone volume of the communication channel.

28 Claims, 1 Drawing Sheet

OTHER PUBLICATIONS

Dan Bour and Prentice Creel, "Foam Cement for Low–Pressure Squeeze Applications", a Southwestern Petroleum Short Course–87, pp. 1–11.

A. Sh. Gazizov, "Increase of Formations Oil Recovery By Application of Polymerdispersive Systems", pp. 929–936, a paper presented at the 6th European IOR–Symposium in Stavanger, Norway (May 21–23, 1991).

Derry D. Sparlin and Raymond W. Hagen, Jr., "Controlling Water in Producing Operations; Part 4—Grouting Materials and Techniques", World Oil, Jun. 1984, pp. 149–154.

Robert E. Maughmer and Dwyan Dalrymple, "Treatment Helps to Decrease Water", The American Oil and Gas Reporter.

Robert M. Beirute, Roberto Bugil, Mike Harrison, and Horacio Rossignoll, "A Cost–Effective Technique for Squeezing Perforations", JPT Magazine dated Feb. 1994.

Prentice Creel and David Kulakofsky, "Computer Simulation Program for Cement Squeeze Applications", pp. 20–31, an article from Southwestern Petroleum Short Course—92.

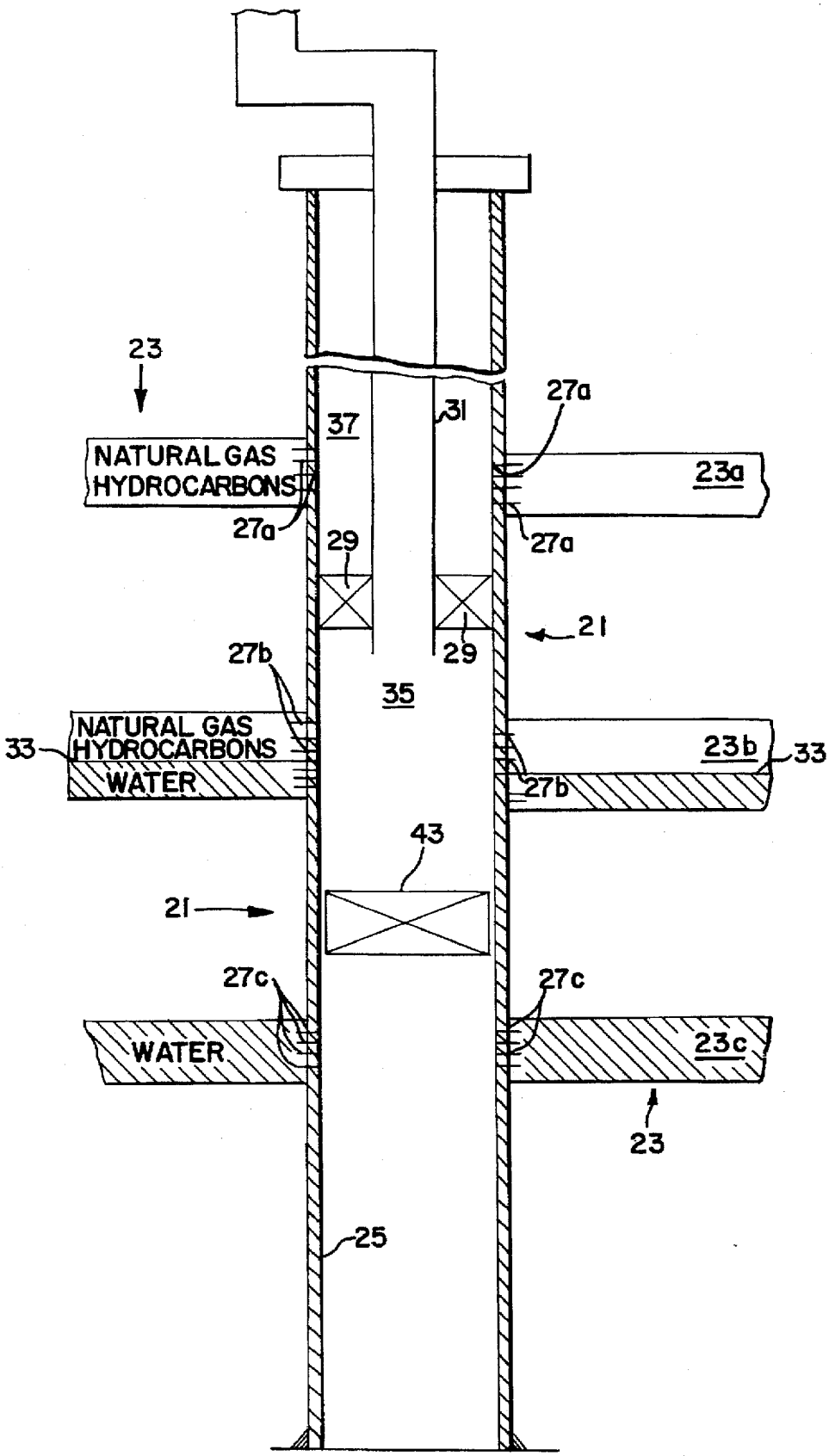
23
37
31
27a
NATURAL GAS
HYDROCARBONS
23a
27a
27a
29
29
21
27b
35
NATURAL GAS
HYDROCARBONS
33
23b
33
WATER
27b
43
21
27c
27c
WATER
23c
23
25

AQUEOUS PARTICULATE DISPERSION FOR REDUCING THE WATER INFLUX RATE INTO A WELLBORE

FIELD OF THE INVENTION

The present invention relates generally to methods for selectively reducing the water permeability within a subterranean formation containing natural gas. More particularly, the invention relates to the use of an aqueous particulate dispersion to minimize the water influx into a wellbore that penetrates the formation.

BACKGROUND OF THE INVENTION

To recover natural gas and associated hydrocarbon condensates (sometimes hereinafter referred to as "natural gas hydrocarbons") from a subterranean formation, a wellbore is drilled into the formation. A communication channel, which extends from the wellbore into the formation, is typically used to improve the recovery of natural gas hydrocarbons from the formation. The communication channel typically is created by hydraulically fracturing the region of the formation surrounding the wellbore. Proppant particles are often introduced into the communication channel to help keep it open. The proppant particles at least partially fill the communication channel and form a tightly packed matrix (hereinafter sometimes referred to as a "proppant pack"). The proppant pack contains an interstitial volume between the proppant particles which provides a fluid flow path from the formation into the wellbore.

The subterranean formation typically contains a hydrocarbon region, where the natural gas hydrocarbons are located, and a water region, which generally underlies the hydrocarbon region. The communication channel formed during the hydraulic fracturing procedure often extends vertically into both the hydrocarbon region and the water region. This results in water being simultaneously recovered with the natural gas hydrocarbons. Also, the upper extent of the water region can rise over time as natural gas hydrocarbons are recovered from the formation. This may result in a greater influx of water into the wellbore over time. The disposal of the recovered water can be expensive. Additionally, the water tends to collect in the bottom of the wellbore, and if not removed can cause a significant reduction in the natural gas hydrocarbon recovery rate from the effected wellbore.

Several methods have been utilized in an attempt to reduce the water influx into a natural gas hydrocarbon recovery wellbore. In one method, a cement slurry is pumped into the formation. It is intended that the cement slurry will penetrate into the proppant pack and thereby reduce the water influx into the wellbore. In this method, the cement slurry usually achieves only relatively shallow penetration into the proppant pack. Also, the cement slurry tends to reduce the entire permeability of the proppant pack, thereby reducing both the water influx rate and the natural gas hydrocarbon recovery rate from the wellbore. In another method, techniques are utilized which are purported to have the ability to selectively reduce the permeability of the subterranean formation to water while not significantly reducing the permeability of the formation to hydrocarbons. These techniques generally use materials which are either hydrophilic or hydrophobic and require the use of selective stimulation techniques which can be expensive and often are not practicable. Further, these techniques often cannot be cost effectively used in a natural gas hydrocarbon recovery wellbore.

What is desired is a relatively inexpensive and simple method for selectively reducing the water influx into a natural gas hydrocarbon recovery wellbore, while at the same time not significantly reducing the natural gas hydrocarbon recovery rate from the wellbore.

SUMMARY

An aqueous particulate dispersion is utilized to reduce the water influx into a wellbore which penetrates a subterranean formation. The aqueous particulate dispersion is introduced into a communication channel which extends from the wellbore into the subterranean formation and which is at least partially filled with proppant particles which form a proppant pack having an interstitial volume comprised of a water zone volume and a hydrocarbon zone volume. The aqueous particulate dispersion is comprised of dispersion particles having an average diameter less than one-third the average diameter of the pore spaces within the interstitial volume. The introduced dispersion particles will be carried outward into the communication channel and will settle within the water zone volume of the proppant pack. These settled particles will reduce the permeability of the lower portion of the proppant pack and thereby reduce the influx of water into the wellbore.

Preferably, the average diameter of the dispersion particles contained in the aqueous particulate dispersion is less than one-sixth the average diameter of the pore spaces within the interstitial volume. More preferably, the average diameter of the dispersion particles contained in the aqueous particulate dispersion is less than one-seventh the average diameter of the pore spaces within the interstitial volume. Most preferably, the average diameter of the dispersion particles contained in the aqueous particulate dispersion is less than one-eighth the average diameter of the pore spaces within the interstitial volume.

In one aspect, the aqueous particulate dispersion is introduced into the communication channel until the volume of the dispersion particles introduced at least equals one-half the water zone volume, preferably, at least equals seventy percent (70%) of the water zone volume, more preferably, between seventy percent (70%) and one hundred fifty percent (150%) of the water zone volume.

In another aspect, a wellbore packer and tubing string are used to direct the aqueous particulate dispersion into the water zone volume.

BRIEF DESCRIPTION OF THE DRAWINGS

FIG. 1 is a diagrammatical elevational view of a wellbore penetrating a subterranean formation.

DESCRIPTION OF THE PREFERRED EMBODIMENTS

The aqueous particulate dispersion is comprised of dispersion particles suspended in water. The concentration of the aqueous particulate dispersion is preferably less than three pounds mass (3 lbs) of dispersion particles per gallon of water, more preferably, less than two pounds mass (2 lbs) of dispersion particles per gallon of water, and most preferably, between one-half and one and one-half pounds mass (½–1.5 lbs) of dispersion particles per gallon of water. In general, if the concentration of the dispersion particles in the dispersion is too high, the particles will tend to bridge within the pore spaces of the proppant pack, thereby reducing the particles' penetration into the pack. If the concentration of the dispersion particles within the aqueous particulate dispersion is too low, an inordinate amount of dispersion will have to be used to introduce the desired quantity of dispersion particles into the water zone volume of the communication channel.

Generally, the dispersion particles should be small enough so that they can penetrate deeply into the interstitial volume of the proppant pack. Dispersion particles with too large a diameter will bridge off within the pore spaces of the proppant pack. Additionally, if the dispersion particles are too small, they will remain suspended and will not readily settle into the water zone volume of the proppant pack.

Numerous types of materials can be used for the dispersion particles. For example, the dispersion particles can be formed from borosilicate, calcium silicate, sodium silicate, potassium silicate, bauxite, and any mixture thereof. The dispersion particles should have a density greater than water so that they will settle out within the communication channel.

Preferably, the dispersion particles should be of a consistent size and shape. As discussed earlier, the average diameter of the dispersion particles should be less than one-third the average diameter of the pore spaces within the proppant pack; preferably, less than one-sixth the average diameter of the pore spaces; more preferably, less than one-seventh the average diameter of the pore spaces; most preferably, less than one-eighth the average diameter of the pore spaces.

Typically, the proppant particles used to form a proppant pack are grouped in size ranges from 60 mesh through 4 mesh as set forth by the American Petroleum Institute (API). Accordingly, the average diameter of the pore spaces within a proppant pack range from 40 microns, for a proppant pack formed from 60 mesh proppant particles, to 800 microns for a proppant pack formed from 4 mesh proppant particles.

Proppant packs are commonly formed from −12+20 mesh proppant particles and −20+40 mesh proppant particles. The average pore space diameter within the proppant pack formed from −20+40 mesh proppant particles is from 72 to 125 microns. The average pore space diameter within the proppant pack formed from −12+20 mesh proppant particles is from 125 to 275 microns.

For proppant packs that are formed from proppant particles that have a range of sizes, it is preferred to use smaller dispersion particles that can pass through all the pore spaces of the proppant pack. Therefore, the dispersion particles more preferably utilized should have an average diameter less than 18 microns for a proppant pack formed from −12+20 mesh proppant particles and less than 10 microns for a proppant pack formed from −20+40 mesh proppant particles.

The aqueous particulate dispersion composition should be one that allows particle settling. Dispersants, polymers or very fine dispersion particles should be avoided.

Common oil-field cement of Classes A, B, C, D, E, F, G, H, or J as set forth by the American Petroleum Institute (API) mixed neat with water preferably are used to make the aqueous particulate dispersion. The Class of cement utilized for a particular application is determined by the size of the pore spaces within the proppant pack.

In general, enough dispersion particles are introduced into the formation so that the water zone volume is sufficiently filled with dispersion particles. When the water zone volume is sufficiently filled, the flow of water through the proppant pack into the wellbore will be significantly reduced. Typically, the water influx rate into the wellbore will be reduced by at least ten percent using the current invention. It is not unusual to see a reduction in the water influx rate of twenty-five to fifty percent. Often, the water influx rate can be reduced by over 70% using the current invention.

The aqueous particulate dispersion is introduced into the communication channel at a pressure less than the fracture parting pressure of the formation. Preferably, the pumping rate of the aqueous particulate dispersion should be high enough to ensure that the dispersion particles do not settle out of the dispersion within the wellbore. Preferably, wellbore packers are utilized to direct the aqueous particulate dispersion into the water zone volume of the proppant pack.

Operation

Referring to FIG. 1, a wellbore 21 which penetrates a subterranean formation 23 is shown. The subterranean formation 23 is shown with three wellbore drainage zones 23*a*, *b*, and *c*. Each wellbore drainage zone 23*a*, *b*, and *c* is intersected by a communication channel (not shown on FIG. 1 ) that extends from wellbore 21 into drainage zones 23*a*, *b*, or *c*. Zones 23*a*, *b*, and *c* are not necessarily geologically or lithologically distinct from one another. The communication channels are at least partially filled by a proppant pack (not shown in FIG. 1). A communication channel may extend vertically through more than one wellbore drainage zone 23*a*, *b*, or *c* and thereby provide fluid communication between zones. However, wellbore drainage zones 23*a*, *b*, and *c* may not be in fluid communication with one another. Wellbore 21 is typically lined with casing 25, which has perforations 27*a*, *b*, and *c*, that provide fluid communication between Zones 23*a*, *b*, and *c* and the interior volume of wellbore 21.

A swab test is typically used to determine if a wellbore drainage zone produces water, natural gas hydrocarbons, or both water and natural gas hydrocarbons. Wellbore drainage zone 23*a* produces substantially only natural gas hydrocarbons and is hereinafter referred to as a "hydrocarbon drainage zone;" wellbore drainage zone 23*b* produces both water and natural gas hydrocarbons and is hereinafter referred to as a "hydrocarbon/water drainage zone;" and wellbore drainage zone 23*c* produces substantially only water and is hereinafter referred to as a "water drainage zone."

Preferably, a wellbore packer 29 mounted on a tubing string 31 is used to direct the aqueous particulate dispersion into the water zone volume.

Wellbore packer 29 and tubing string 31 are lowered into wellbore 21 to a vertical location near a water/hydrocarbon interface 33. Wellbore packer 29 is activated to form a lower wellbore volume 35 located below packer 29 and an upper wellbore volume 37 located above packer 29. The aqueous particulate dispersion is pumped through tubing string 31 into lower wellbore volume 35, where it is directed into the water zone volume of the interstitial volume of the communication channel.

Wellbore packer 29 is preferably placed so that the hydrocarbon drainage zone is in fluid communication with upper wellbore volume 37. This arrangement will direct the aqueous particulate dispersion into the water zone volume. Additionally, wellbore packer 29 preferably is placed so that the hydrocarbon/water drainage zone is in fluid communication with lower wellbore volume 35. This will help minimize any near wellbore water coning which could occur after the well is returned to natural gas hydrocarbon recovery operations.

A water drainage zone that is not in fluid communication with its overlying hydrocarbon/water drainage zone or hydrocarbon drainage zone preferably is isolated from the overlying zones using a bridge plug 43.

In some aspects of the invention, the volume of the dispersion particles introduced into the formation should be equal to or greater than one-half (½) the volume of the water zone volume of the proppant pack; preferably, the volume of the dispersion particles introduced should be equal to or greater than seventy percent (70%) of the volume of the water zone volume; more preferably, between seventy and one hundred fifty percent (70%–150%) of the water zone volume.

The water zone volume can be determined in a manner known to one of ordinary skill in the art. In general, the size of the communication channel and the porosity of the interstitial volume of the proppant pack are first determined using data recorded during the hydraulic fracture treatment used to form the communication channel. Next, the location of the water hydrocarbon interface is determined using methods known to one of ordinary skill in the art. The above information is then used to determine the water zone volume.

For example, a fracture modeling program, such as "Stimplan", which is distributed by NSI, Inc. of Tulsa, Okla. can be used to estimate the volume of the communication channel and the volume and porosity of the proppant pack. In general, wellbore data recorded during a fracture treatment of wellbore 21—such as the surface and downhole pressure during the injection of the fracturing fluid, the downhole shut-in pressures during the initial shut-in of wellbore 21, and the closure stresses, permeability, and the formation moduli—are input into the fracture modeling software program. The modeling program is then matched to the data in order to determine the estimated size and geometry of the communication channel created during the fracture stimulation, and the estimated porosity of the proppant pack.

The water/hydrocarbon interface can be determined by using a swab test which systematically isolates selected regions of the wellbore and measures the influx of water into the selected wellbore regions.

From the foregoing description, it will be appreciated that numerous variations, alternatives and modifications will be apparent to those skilled in the art. Accordingly, this description is to be construed as illustrative only and is for the purpose of teaching those skilled in the art the manner of carrying out the invention. Various changes may be made and materials substituted for those described herein. For example, the method may be utilized on a wellbore which is completed open-hole. It is of course intended that all such modifications are covered by the appended claims.

We claim:

1. A method for reducing the water influx into a wellbore penetrating a subterranean formation having a communication channel extending from the wellbore into the formation, wherein the communication channel is comprised of proppant particles and an interstitial volume between the proppant particles, the interstitial volume comprised of a water zone volume and a hydrocarbon zone volume, the method comprising the steps of:

a) introducing into the communication channel an aqueous particulate dispersion comprised of dispersion particles having an average diameter less than one third an average diameter of the pore spaces within the interstitial volume; and b) ceasing to introduce the aqueous particle dispersion when a volume of the dispersion particles introduced in step a) is at least equal to about one half the water zone volume.

2. The method of claim 1, wherein the aqueous particle dispersion is introduced until the volume of the dispersion particles introduced in step a) is at least equal to about 70% of the water zone volume.

3. The method of claim 2, wherein the volume of the dispersion particles introduced in step a) is equal to or less than about 150% of the water zone volume.

4. The method of claim 1, wherein the average diameter of the dispersion particles introduced in step a) is less than about one-sixth the average diameter of the pore spaces within the interstitial volume.

5. The method of claim 1, wherein the average diameter of the dispersion particles introduced in step a) is less than about one-seventh the average diameter of the pore spaces within the interstitial volume.

6. The method of claim 1, wherein the aqueous particle dispersion is comprised of less than about three pounds of dispersion particles per gallon of water.

7. The method of claim 1, wherein the aqueous particle dispersion is comprised of between about 0.5 and 1.5 pounds of dispersion particles per gallon of water.

8. The method of claim 7, wherein the dispersion particles comprise cement selected from the group consisting of: Classes A, B, C, D, E, F, G, H, J, and mixtures thereof.

9. The method of claim 7, wherein the dispersion particles comprise cement having an average particle diameter of between 10 and 110 microns.

10. The method of claim 1, wherein the proppant particles are selected from the group consisting of sand, bauxite, and mixtures thereof and the average diameter of the pore spaces within the interstitial volume is from about 40 to 800 microns.

11. The method of claim 1, wherein the communication channel was created by hydraulically fracturing the subterranean formation.

12. A method for minimizing the water influx into a wellbore penetrating a subterranean formation having a communication channel extending from the wellbore into the formation, wherein the communication channel is at least partially filled with a proppant pack having a water zone volume and a hydrocarbon zone volume, and wherein the communication channel was created by hydraulically fracturing the formation surrounding the wellbore, the method comprising the step of introducing into the communication channel a sufficient quantity of aqueous particulate dispersion, comprised of cement particles having an average particle diameter of between 10 and 110 microns, to fill the water zone volume with a volume of cement particles at least equal to one-half the water zone volume.

13. The method of claim 12, wherein the aqueous particulate dispersion is comprised of less than about three pounds of cement, selected from the group consisting of Classes A, B, C, D, E, F, G, H, J, and mixtures thereof, per gallon of water.

14. The method of claim 12, wherein the aqueous particulate dispersion is comprised of less than about two pounds of cement, selected from the group consisting of Classes A, B, C, D, E, F, G, H, J, and mixtures thereof, per gallon of water.

15. The method of claim 12, wherein the aqueous particulate dispersion is comprised of between about 0.5 and 1.5 pounds of cement, selected from the group consisting of Classes A, B, C, D, E, F, G, H, J, and mixtures thereof, per gallon of water.

16. The method of claim 12, wherein the proppant pack is comprised of proppant particles selected from the group consisting of –4+8, –8+12, –12+16, –12+20, –16+20, –20+

30, –20+40, and –40+60 mesh sand, sintered bauxite, and mixtures thereof and an average diameter of the pore spaces within the proppant pack is from about 40 to about 800 microns.

17. The method of claim 16, wherein the aqueous particulate dispersion is introduced into the communication channel at a pressure less than the fracture parting pressure of the formation.

18. The method of claim 17, wherein the aqueous particulate dispersion is introduced into the communication channel at a sufficient rate to minimize any settling of the cement particles within the wellbore.

19. The method of claim 17, wherein the aqueous particulate dispersion is introduced into the communication channel at a rate of from about 20 to 2000 gallons per minute.

20. The method of claim 12, wherein the method further comprises placing a wellbore packer in the wellbore at a vertical location below a water/hydrocarbon interface, the wellbore packer creating a lower wellbore region and an upper wellbore region, and wherein the aqueous particulate dispersion is introduced into the lower wellbore region which directs the dispersion into the water zone volume.

21. A method for reducing the water influx into a wellbore penetrating a natural gas hydrocarbon-containing subterranean formation having a communication channel extending from the wellbore into the formation, wherein the communication channel is at least partially filled with a proppant pack having a water zone volume, and wherein the communication channel was created by hydraulically fracturing the formation surrounding the wellbore, the method comprising the steps of:

a) placing a wellbore packer in the wellbore to form an upper wellbore volume and a lower wellbore volume, the packer carrying tubing which extends through the upper wellbore volume and terminates in the lower wellbore volume;

b) supplying an effective amount of an aqueous particulate dispersion comprised of between about 0.5 and 3.0 pounds of dispersion particles per gallon of water through the tubing and the lower wellbore volume and into the water zone volume to reduce the water influx rate into the wellbore, the dispersion particles having an average diameter less than one-third the average diameter of the pore spaces within the proppant pack.

22. The method of claim 21, wherein enough aqueous particulate dispersion is supplied to the water zone volume to reduce the water influx rate into the wellbore by 10%.

23. The method of claim 21, wherein enough aqueous particulate dispersion is supplied to the water zone volume to reduce the water influx rate into the wellbore by 25%.

24. The method of claim 21, wherein enough aqueous particulate dispersion is supplied to the water zone volume to reduce the water influx rate into the wellbore by 50%.

25. The method of claim 21, wherein enough aqueous particulate dispersion is supplied to the water zone volume to reduce the water influx rate into the wellbore by 70%.

26. The method of claim 21, wherein the formation is comprised of a hydrocarbon drainage zone, and a hydrocarbon/water drainage zone, and wherein the interior radius of the wellbore is lined with casing having perforations which provide fluid communication between the formation and the wellbore, the method further comprising the step of placing the wellbore packer at a location within the wellbore to isolate the hydrocarbon drainage zone from the lower wellbore volume.

27. The method of claim 26, wherein the wellbore packer is placed at a location within the wellbore so that the hydrocarbon/water drainage zone is in fluid communication with the lower wellbore volume.

28. The method of claim 26, wherein the formation is further comprised of a water drainage zone, the method further comprising placing a bridgeplug within the wellbore to isolate the water drainage zone from the lower wellbore volume.

* * * * *